United States Patent [19]

Horiuchi et al.

[11] 4,099,988

[45] Jul. 11, 1978

[54] COMPOSITE MATERIAL HAVING WEAR- AND IMPACT-RESISTING SURFACE AND PROCESS FOR PRODUCING SAME

[75] Inventors: Kaoru Horiuchi, Toride; Akio Matsui; Yoshio Okamoto, both of Chiba, all of Japan

[73] Assignee: Kawasaki Jukogyo Kabushiki Kaisha, Tokyo, Japan

[21] Appl. No.: 770,029

[22] Filed: Feb. 18, 1977

[30] Foreign Application Priority Data

Feb. 26, 1976 [JP] Japan ..... 51/20500
Feb. 26, 1976 [JP] Japan ..... 51/20501

[51] Int. Cl.[2] ..... B22D 19/02
[52] U.S. Cl. ..... 148/3; 148/39; 148/127
[58] Field of Search ..... 148/2, 3, 127, 39, 35; 75/123 CB, 126 A, 128; 164/98, 108, 112

[56] References Cited

U.S. PATENT DOCUMENTS

| | | | |
|---|---|---|---|
| 1,179,696 | 4/1916 | Canda | 428/614 |
| 2,105,048 | 1/1938 | Lauenstein et al. | 148/3 |
| 2,155,215 | 4/1939 | Beament | 148/3 |
| 2,367,286 | 1/1945 | Keeleric | 164/112 |
| 3,355,264 | 11/1967 | Kempe | 428/676 |
| 3,574,605 | 4/1971 | Hall et al. | 75/128 V |

FOREIGN PATENT DOCUMENTS

| | | | |
|---|---|---|---|
| 1,119,516 | 7/1968 | United Kingdom | 75/126 A |

*Primary Examiner*—W. Stallard
*Attorney, Agent, or Firm*—Lane, Aitken, Dunner & Ziems

[57] ABSTRACT

A composite material is produced by placing a plurality of blocks of cast iron having high wear-resisting properties on the bottom of a mold, pouring into the mold a molten impact-resisting cast steel, allowing the molten steel to solidify and subjecting the solidified mold to a heat treatment. The composite material thus produced can exhibit both excellent wear- and impact-resisting properties.

13 Claims, 7 Drawing Figures

A

B

COMPOSITE MATERIAL HAVING WEAR- AND IMPACT-RESISTING SURFACE AND PROCESS FOR PRODUCING SAME

BACKGROUND OF THE INVENTION

This invention relates to a composite material having improved wear- and impact-resisting properties and a process for the production of same.

In the fields of mining, civil engineering and construction, cememt, and iron industries, it is general that cast steel parts used for machine apparatus and other industrial facilities are required to have an excellent resistance to impact and as well as a resistance to wear.

Wear-resisting cast steel parts have been heretofore made of high chromium cast iron, high manganese cast steel, high chromium cast steel, low alloy steel, etc. However, these materials have some drawbacks that they are poor in either toughness or wear-resisting property. A material which shows both toughness and wear-resisting property has not been found yet. Therefore, the cast steel should be properly selected depending on the purpose in end use. To cope with this problem, there has been proposed a composite material composed of two kinds of materials with different mechanical properties. As shown in FIGS. 1-A and 1-B, for example, there is known a composite material which includes a base metal 1 having high toughness and a plurality of highly hard steel ingot blocks 2. The composite material is excellent in toughness and wear-resisting property and can be used as, for example, an impact plate for grinder or crusher for lubricant-free soil and sand, stones and rocks, etc. However, since fixing of the plurality of highly hard blocks 2 to the base metal 1 is made by a method using adhesives, a method using bolted connections or a method using brazing, such composite material has the following drawbacks. A composite material produced by using adhesives must be used within a limited temperature range. Blazing method is disadvantageous in that fixing of blocks to a base metal must be made at limited portions. The bolt connection presents a problem that the highly hard block is almost impossible to be tapped. If bolts have been previously incorporated into the block, there is a danger that the block is to break or crack. Further, to attach bolts requires additional steps and is thus disadvantageous in economy.

SUMMARY OF THE INVENTION

The present invention provides a composite article having both impact- and wear-resisting properties, which includes an impact-resisting cast steel base material and at least one, generally a plurality of wear-resisting cast iron blocks embedded in the base material and a process for producing same.

In order to effect fixing of the blocks to the base material in a simple and excellent manner, the process of the invention includes placing a plurality of blocks to the bottom of a mold, generally a sand mold, pouring a molten cast steel into the mold. After removing the thus formed molded material from the mold, a heat treatment is conducted to produce the desired composite article.

It is accordingly an object of this invention to provide a composite article which is useful as a member exposed to both wearing and impacting conditions, such as an operating plate and an impact plate of a crusher.

It is another object of the invention to provide an economical process for the production of a composite article thereby avoiding the above-mentioned disadvantages of the prior art processes concerning fixing.

It is a further object of this invention to provide a process which allows the production of a composite article having a surface exhibiting both excellent impact- and wear-resisting properties.

BRIEF DESCRIPTION OF THE DRAWING

Other objects, features and advantages of the present invention will become more apparent from the following detailed description of preferred embodiments when considered together with the drawings, in which:

FIG. 1-B is a cross-sectional view taken along the line I—I of FIG. 1-A;

DETAILED DESCRIPTION OF THE PREFERRED EMBODIMENTS OF THE INVENTION

Figure 1:
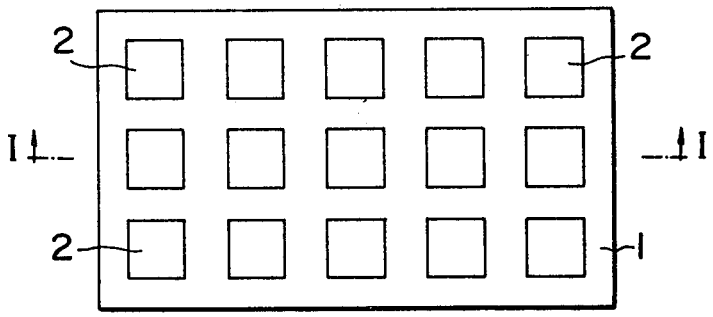
FIG. 1-A is a plan view schematically showing one example of known composite material.
Figure 1:
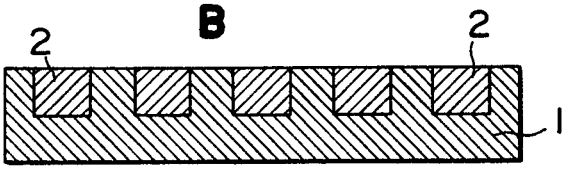
Figure 2:
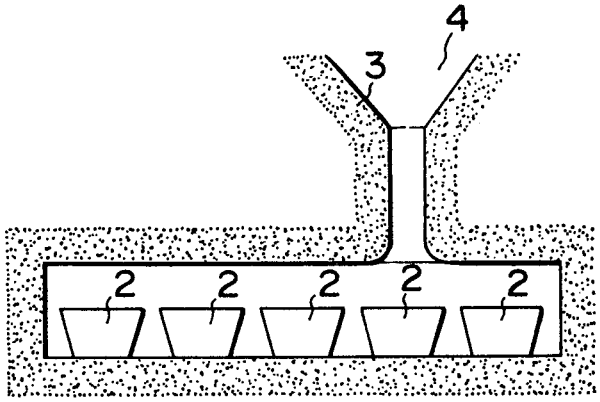
FIG. 2 is a cross-sectional view schematically illustrating fabrication of a composite material according to the invention.

Referring to FIG. 2, a plurality of wear-resisting cast iron blocks 2 are first placed on the bottom a mold 3 at suitable intervals preferably in a zigzag pattern. It is preferred to fix the blocks 2 to the mold 3 with the use of an adhesive agent and any other suitable ways. A molten cast steel 1 having high toughness (base material) is then poured into the mold 3 preferably from a gate 4 provided at the top thereof. By this, strong bonding is effected between the blocks and the base material at their contacts.

In this connection, it is advantageous to use frusto-conical or frusto-pyramidal shaped blocks in that even if some of the blocks are cracked during usage, they may not be removed from the base material.

After the molten cast iron completely solidifies, the unitary molded material thus obtained is released from the mold and is then subjected to a heat treatment which includes the steps of heating the molded material at a temperature of generally between 900° and 1,150° C, preferably between 1,000° and 1,100° C and rapidly cooling the heated material in air to a normal temperature, whereby producing desired composite article having wear- and impact-resisting properties. A period of time required for such heat treatment varies according to the mass of the molded material.

It is preferred that the wear-resisting cast iron be a high chromium cast iron having the composition of 2.80 – 3.60% of C, 0.50 – 1.50% of Si, 0.50 – 1.50% of Mn, 15.00 – 27.00% of Cr, 0.30 – 3.00 of Mo, 0.30 – 3.00% of V and a balance essentially Fe. Preferred base material is an austenite steel having the composition of 0.30 – 1.30% of C, 0.60 – 1.00% of Si, 11.00 – 17.00% of Mn, 1.00 – 17.00% of Cr, 0.50 – 1.50% of Mo, 2.00 – 4.00% of Ni, and a balance essentially Fe.

When the block having such composition is subjected to the heat treatment as mentioned hereinbefore, the resulting block can exhibit most excellent hardness (Shore hardness Hs of 85 – 95) among known wear-resisting cast irons or steels, and thus shows excellent wear-resisting property. Through such thermal treatment, the base material having the above-mentioned composition can form an austenitic structure which ensures both high toughness and work hardness. Accordingly, the two materials are considered to be a most preferable combination for the composite material. More particularly, when the composite article composed of such a block of a high chromium cast iron and a base material of an austenite cast steel is subjected to an impact condition, the surface of the base material forms a martensite structure by work hardening and, thus, wear-resisting property of the base material is considerably improved. Furthermore, such martensite transformation causes expansion of the base material, which in turn serves to improve bonding between the blocks and the base material.

The following example will serve to further illustrate the present invention, in which fabrication of a composite armor plate for use in a blast furnace is described.

EXAMPLE (1) Materials And Compositions

Highly hard blocks 2 were made of a high chromium cast iron having the composition shown in Table below. A base metal 1 was an austenitic cast steel having the composition shown in the Table.

| constituents materials | C | Si | Mn | Cr | Mo | Ni | V | Fe |
|---|---|---|---|---|---|---|---|---|
| highly hard block | 2.97 | 0.68 | 0.76 | 26.42 | 0.86 | — | 0.41 | balance |
| base metal | 0.38 | 0.70 | 15.91 | 16.20 | 1.06 | 2.28 | — | balance |

(2) Shape and Dimension of Composite Armor Plate

Figure 3:
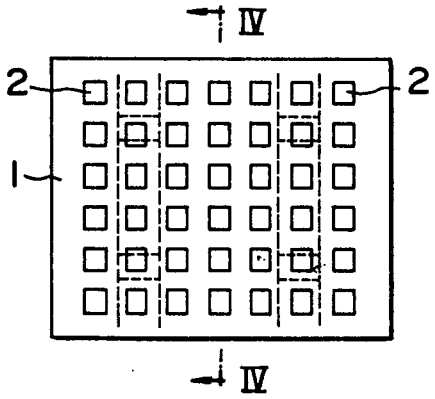
FIG. 3 is a plan view of an armor plate for use in a blast furnace.
Figure 4:
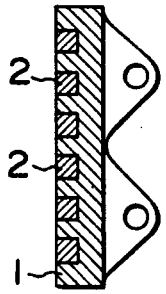
FIG. 4 is a cross-sectional view taken along the line IV—IV of FIG. 3.
Figure 5:
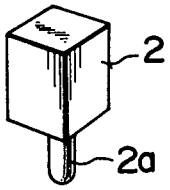
FIG. 5 is a schematical perspective view of a highly hard block with a protrusion portion.

FIG. 3 is a schematical plan view of an armor plate for a blast furnace to be produced. The armor plate had a length of 1000 mm and a width of 1200 mm. While, as shown in FIG. 5, the highly hard blocks 2 were each in the form of a rectangular parallelepiped having a size of 40 × 40 × 60 mm. 360 (18 × 20) pieces of the highly hard blocks 2 were distributed at equal distances in each longitudinal and transversal directions in such a manner that, as shown in FIG. 4, one surface of each of the blocks was on the same plane as the base metal with regard to the wearing surface of the armor plate. The total weight of the plate was 850 kg.

(3) Casting Procedure

Figure 6:
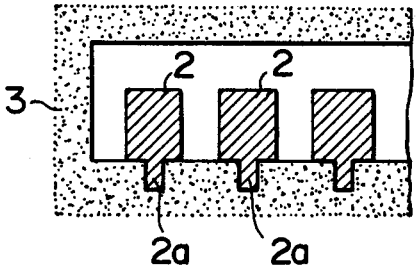
FIG. 6 is a schematical view, in a section, of a mold prior to casting.

Each of the blocks 2 had a protrusion 2*a* with a diameter of 10 mm and a length of 15 mm and was inserted for fixation into respective hollow cavities provided at the bottom of the mold as shown in FIG. 6. Then, molten base metal was poured into the mold.

(4) Thermal Treating Conditions

After the molten base metal completely solidified, the molded article was released from the mold and each of the protrusions was cut off. The molded article was then heated to and maintained at 1100° C and then forcibly air-cooled to produce the composite armor plate.

The highly hard blocks 2 of the armor plate which was fabricated by the process described above had Shore hardness of 80 – 85. The base metal had an impact strength of about 2.0 kg.m/cm$^2$. The composite plate was excellent in both resistance to wear and toughness.

What is claimed is:

1. A process for producing a composite material having at least one impact and wear resisting surface comprising the steps of:

placing on the bottom of a mold at least one wear resisting cast iron block having a chromium content of between 15 to 27%;

pouring into the mold a molten impact resisting cast steel;

allowing said molten cast steel to solidify, thereby forming a molded material;

removing said molded material from the mold; and subjecting said molded material to a heat treatment after removal from said mold whereby said molded material is heated to a temperature of between 900° and 1150° C and then rapidly cooled in air.

2. The process according to claim 1, wherein said step of placing of the block comprises inserting a protrusion portion of the block into a hollow cavity provided in the bottom of the mold for fixing.

3. The process according to claim 1, wherein said step of placing of the block comprises fixing the block to the bottom of the mold with the use of an adhesive agent.

4. The process according to claim 1, wherein said molten cast steel consists essentially of from 0.30 to 1.30% carbon, from 0.60 to 1.00% silicon, from 11.00 to 17.00% manganese, from 1.00 to 17.00% chromium, from 0.50 to 1.50% molybdenum, from 2.00 to 4.00% nickel and balance essentially iron.

5. The process according to claim 1, wherein said block is made of a high chromium cast iron consisting essentially of from 2.80 to 3.60% carbon, from 0.50 to 1.50% silicon, from 0.50 to 1.50% manganese, from 15.0 to 27.0% chromium, from 0.30 to 3.00% molybdenum, from 0.30 to 3.00% vanadium and balance essentially iron.

6. A composite material produced by the process of claim 1.

7. A composite material having at least one impact and wear resisting surface comprising:

a base member of impact resisting cast steel; and at least one wear resisting cast iron block having a chromium content of between 15–27% embedded in said base member, said base member being melt-adhered to said block at their contacts and at least a portion of said block being exposed at the surface of said base member to form said impact and wear resisting surface.

8. The composite material according to claim 7 wherein said base member is made of an austenite cast steel consisting essentially of from 0.30 to 1.30% carbon, from 0.60 to 1.00% silicon, from 11.00 to 17.00% manganese, from 1.00 to 17.00% chromium, from 0.50 to 1.50% molybdenum, from 2.00 to 4.00% nickel and balance essentially iron.

9. The composite material according to claim 7, wherein said block is made of a high chromium cast iron consisting essentially of from 2.80 to 3.60% carbon, from 0.50 to 1.50% silicon, from 0.50 to 1.50% manganese, from 15.0 to 27.0% chromium, from 0.30 to 3.00% molybdenum, from 0.30 to 3.00% vanadium and balance essentially iron.

10. The composite material according to claim 7, wherein said block has an enlarged surface at one side and a smaller surface at opposite side and is embedded in the base number with said smaller surface exposing on the surface of the base member.

11. The composite material according to claim 10, wherein said block is of a frusto-conical shape.

12. The composite material according to claim 10, wherein said block is of a frusto-pyramidal shape.

13. The composite material according to claim 7, which comprises a plurality of blocks generally equally spaced with each other.

* * * * *